US005644891A

United States Patent [19]

Kafarowski

[11] Patent Number: 5,644,891

[45] Date of Patent: Jul. 8, 1997

[54] MORTAR PLOW FOR USE IN THE MANUFACTURE OF BRICK WALL PANELS

[76] Inventor: Zygmunt Grant Kafarowski, P.O. Box 149, 523 Bower Road, Concord, Ontario, Canada, L4K 1B2

[21] Appl. No.: 439,572

[22] Filed: May 11, 1995

[30] Foreign Application Priority Data

Jul. 22, 1994 [CA] Canada ..... 2128644

[51] Int. Cl.[6] ..... E04B 2/54; E04B 2/88

[52] U.S. Cl. ..... 52/745.05; 52/235; 52/508; 52/513; 52/747.12; 249/96; 264/69; 264/273; 264/278; 425/432; 425/458

[58] Field of Search ..... 52/235, 236.7, 52/508, 513, 561, 562, 565, 568, 511, 712, 745.05, 745.09, 745.1, 745.13, 745.19, 747.1, 747.12; 249/53 M, 96; 264/69, 273, 278; 425/425, 432, 456, 458

[56] References Cited

U.S. PATENT DOCUMENTS

| | | | |
|---|---|---|---|
| 654,733 | 7/1900 | Humes | 52/562 |
| 1,280,173 | 10/1918 | Cutler | 52/712 |
| 1,697,760 | 1/1929 | Foans | 52/508 |
| 2,074,483 | 3/1937 | Mason et al. | 52/561 X |
| 2,094,703 | 10/1937 | Hitzman | 249/53 M |
| 2,160,792 | 5/1939 | Cantwell | 52/513 X |
| 2,465,871 | 3/1949 | Hardie et al. | 52/712 X |
| 3,109,193 | 11/1963 | Erickson | 425/458 X |
| 3,231,646 | 1/1966 | Conder et al. | 249/96 X |
| 3,763,796 | 10/1973 | Venable, Jr. | 52/568 X |
| 3,822,336 | 7/1974 | Hazelwood et al. | 264/273 X |
| 4,091,585 | 5/1978 | Rudichuk | 52/568 X |
| 4,190,999 | 3/1980 | Hampton | 52/565 X |
| 4,633,638 | 1/1987 | Ash | 52/562 |
| 4,756,136 | 7/1988 | Hodges | 52/712 X |
| 4,765,115 | 8/1988 | Pollina | 52/562 X |
| 4,768,322 | 9/1988 | Kafarowski . | |
| 4,774,791 | 10/1988 | Kafarowski . | |
| 4,852,320 | 8/1989 | Ballantyne | 52/513 X |
| 4,957,685 | 9/1990 | Boot | 264/273 X |
| 4,970,842 | 11/1990 | Kappeler et al. | 52/565 X |
| 5,173,233 | 12/1992 | Kafarowski . | |
| 5,230,189 | 7/1993 | Sourlis | 52/562 X |

FOREIGN PATENT DOCUMENTS

| | | | |
|---|---|---|---|
| 2839095 | 3/1980 | Germany | 52/508 |
| 1027173 | 4/1966 | United Kingdom | 52/568 |

*Primary Examiner*—Carl D. Friedman
*Assistant Examiner*—Kevin D. Wilkens
*Attorney, Agent, or Firm*—Riches, McKenzie & Herbert

[57] ABSTRACT

An improved method of manufacturing an integral brick wall panel and particularly a novel vibrating mortar plow for use in such method to assist filling the mortar spaces between bricks and holes in the bricks with mortar. The vibrating mortar plow of the invention has a bottom mortar engaging face having a plurality of spaced, parallel fins which are adapted to be received in the mortar spaces between adjacent rows of bricks. The integral brick wall panel is provided with a plurality of cantilevering connectors by which the brick wall panel can be directly connected to a building structure or by which it can be connected to a backing layer to form a composite wall panel.

5 Claims, 10 Drawing Sheets

15
17
18
12
11
44
20
43
45
52
51
55
62
63
65
44A
63
64

FIG. 11.
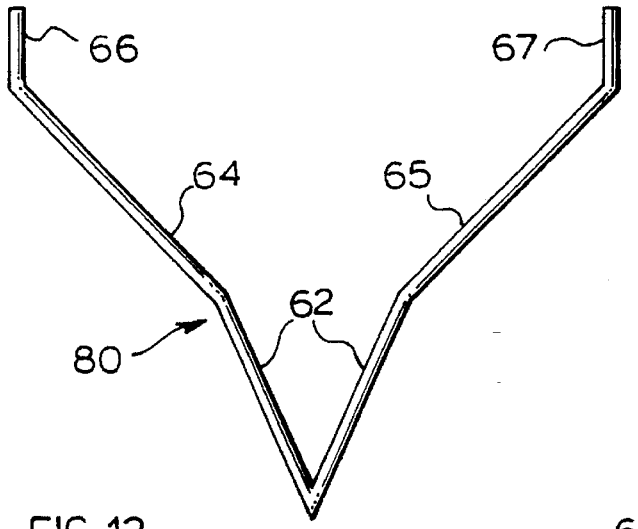
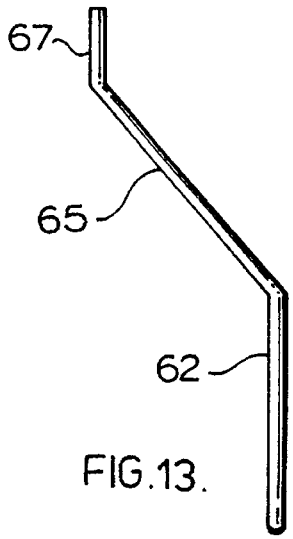
FIG. 13.
FIG. 12.
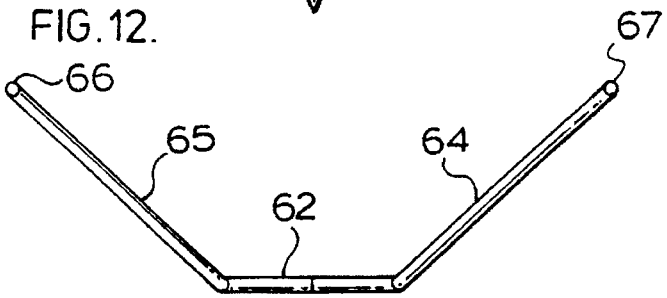
FIG. 16.
FIG. 14.
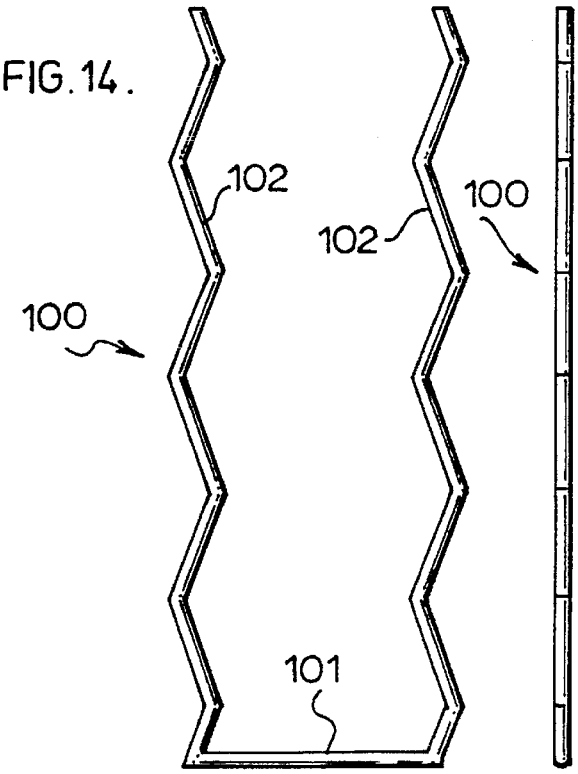
FIG. 15.
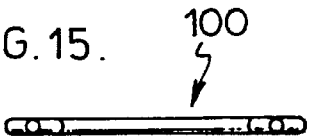

MORTAR PLOW FOR USE IN THE MANUFACTURE OF BRICK WALL PANELS

SCOPE OF THE INVENTION

This invention relates to an integral wall panel formed from conventional masonry bricks joined together with cement mortar, a mortar plow useful for making such panels, and a method of manufacture of such an integral wall panel.

BACKGROUND OF THE INVENTION

Masonry bricks have been, and are today, a very popular material for forming decorative outer faces of buildings. Brick is both more durable and arguably more aesthetically pleasing than many of the more recently developed materials used as facings on building structures.

Brick building facings are typically constructed by hand, with bricklayers laying each individual brick in the facing. Manual construction dictates that brick building facings must be constructed vertically atop a rigid support such as a floor member or a ledge. The floor member or ledge therefore supports substantially the entire weight of the brick facing. In typical multi-storey building construction, each floor of the building supports the weight of a brick facing extending the height of one storey.

Modern facing materials such as glass and precast concrete have advantages over standard brick facings in that they can be formed into large unitary panels which are quickly and easily installed by attachment on a building structure. The rear surface of such a panel is typically provided with bolts or brackets by which it is bolted or otherwise attached onto building structural members such as steel structural beams, concrete beams or walls. The unitary nature of such a panel allows it to be supported, or "hung", on the building structure by the bolts or brackets.

Obviously, the labour-intensive nature of forming brick building facings may make brick construction expensive compared to other types of facings, such as unitary glass and precast concrete panels.

To overcome the cost disadvantages of brick as a facing material, integral wall panels formed from conventional masonry bricks have been proposed as building facings. These integral wall panels are typically formed on their front faces, with the bricks being arranged in rows on a flat surface, such that the front surface of the wall panel is face down during its construction. Mortar is then spread over the rear surface of the panel and is forced into the mortar spaces between the bricks.

However, integral brick wall panels formed in this way have the disadvantage that they tend not to be as strong as conventional brick walls in which individual bricks are laid by hand. One reason for the lack of strength is that it is difficult to make mortar flow into the narrow spaces between the bricks during the manufacture of an integral brick wall panel. Therefore, the spaces between individual bricks may not become completely filled with mortar, resulting in weak mortar joints between bricks.

Further, conventional masonry bricks typically have a plurality of holes passing through them. When the bricks are set in place, the holes in bricks of adjacent rows align so that the holes form continuous columns throughout substantially the entire height of the brick wall panel. In conventional bricklaying, these holes are not filled with mortar. The present inventor has appreciated that if these columns may be completely filled with mortar, the strength of the brick wall panel is greatly increased. However, when making an integral brick wall panel, just as it is difficult to force mortar to flow into the spaces between bricks, it is even more difficult to ensure mortar completely fills the holes within the bricks. The disadvantage exists that no satisfactory method for filling the holes and the mortar spaces in integral brick wall panels has been proposed.

SUMMARY OF THE INVENTION

To at least partially overcome these disadvantages, the present invention provides an improved method of manufacturing an integral brick wall panel and particularly a novel vibrating mortar plow for use in such method to assist filling the mortar spaces between bricks and holes in the bricks with mortar.

The vibrating mortar plow of the invention has a bottom mortar engaging face having a plurality of spaced, parallel fins which are adapted to be received in the mortar spaces between adjacent rows of bricks.

The mortar plow of the present invention is specially designed to ride on a bed of wet mortar on the rear surface of a brick wall panel, with the fins extending into the mortar spaces to guide the plow along the rows of bricks.

By moving the mortar plow back and forth along the rows of bricks with vibration, mortar is forced by the fins to flow downward between the bricks to substantially completely fill the mortar spaces between bricks and the holes in the bricks.

The method of the present invention produces integral brick wall panels wherein the holes in the bricks and the mortar spaces between bricks are substantially completely filled with mortar and which thereby have surprising strength. Unlike known integral brick wall panels, the integral brick wall panels of the present invention have sufficient strength and cohesion that they can be hung as unitary panels on building structures.

The present invention provides an integral brick wall panel having on its rear surface a plurality of cantilevering connectors by which the brick wall panel can be connected to a building structure. The cantilevering connectors support the entire weight of the panel so that it does not need to be supported by a floor member or ledge.

The present invention also provides a composite wall panel which can be hung on a building structure, the composite panel having an outer decorative face comprising an integral brick wall panel and a backing layer preferably comprising precast concrete or steel. The brick wall panel is supported in spaced relation away from the backing layer by cantilevering connectors, thus providing an insulating air space between the brick layer and the backing layer.

One object of the present invention is to provide a mortar plow for use in the manufacture of integral brick wall panels.

Another object of the present invention is to provide an economical method for manufacturing brick wall panels.

Another object of the present invention is to provide a method of manufacturing integral brick wall panels using a vibrating mortar plow.

Another object of the present invention is to provide an integral brick wall panel which can be supported by cantilevering connectors.

Another object of the present invention is to provide a composite wall panel having an integral brick wall panel facing spaced from a backing layer.

The mortar plow of the present invention has been specifically designed for use in the manufacture of integral brick wall panels, wherein a layer of mortar is provided on the rear surface of the wall panel and worked into the mortar spaces between the bricks. The mortar plow has a bottom mortar engaging face which carries a plurality of spaced, parallel fins which are adapted to be received in the mortar spaces between adjacent rows of bricks and guide the movement of the plow along the rows of bricks.

The plow is preferably vibrated and moved along the rows of bricks with the bottom face of the plow riding on a layer of wet mortar. The agitating action of the fins causes the wet mortar to flow downward into the mortar spaces between the adjacent bricks and into the holes in the bricks, substantially completely filling the mortar spaces and the holes.

The mortar plow preferably also has a forward mortar engaging plowing face which pushes and spreads the mortar when the plow is moved forwardly. The forward face preferably comprises flow guides located intermediate the fins which direct the mortar laterally into alignment with the fins when the plow is moved forwardly. The mortar directed laterally by the flow guides is then directed downwardly by the action of the fins into the mortar spaces and the holes in the bricks.

The inventor has surprisingly found that, by use of the mortar plow of the present invention, the mortar spaces between adjacent bricks as well as the holes through the bricks become substantially completely filled with mortar. By substantially completely filling the mortar spaces and the holes in the bricks, the resultant panel has very surprising strength. This is partially due to the formation of continuous columns of mortar throughout substantially the entire height of the panel.

Integral brick wall panels made according to the method of the present invention have sufficient strength and cohesion that they can be hung as unitary panels on building structures. Unlike conventional hand-lain brick building facings and known integral brick wall panels, integral brick wall panels of the present invention do not need to be supported on a ledge or floor member.

The brick panels of the present invention are preferably provided with a plurality of cantilevering connecting ties spaced substantially uniformly over the rear surface of the panel. The ties are preferably sufficient in strength and number to support the entire weight of the brick panel. One end of each tie is preferably embedded in the mortar of the brick panel and the other end preferably projects from the rear surface. The projecting end of each tie is provided for connection to a structural member of a building.

The brick wall panel of the present invention may also be used as the outer, decorative face of a composite wall panel having a precast concrete or steel backing. Concrete backings are well known in the art and are used in other contexts, such as to support granite or marble facing panels and the like. Instead of concrete, a gridwork or framework of welded angle iron could be used.

In a preferred composite wall panel of the present invention, the brick panel is provided with rearwardly extending connecting ties. Each tie preferably has at least one projecting end embedded in a precast concrete backing or connected to a steel backing by bolts, brackets, or welding. The brick panel is thereby hung from the backing by the ties, an insulating air space preferably being provided between the backing and the brick panel, with the ties extending across the air space.

In a composite panel, it is preferred that a layer of insulation, such as rigid insulation, be provided on the backing, with an air space being provided between the insulation and the brick panel.

The backing of the composite panel of the present invention preferably has bolts or brackets for attachment to a building structural member, such as a steel structural beam.

The surprising strength and cohesion of the brick wall panels of the present invention allow them to be used in a similar fashion to glass and precast concrete panels, which are typically hung merely cantilevered as unitary panels on building structures.

In one aspect, the present invention provides a method for manufacturing integral wall panels from masonry bricks using a vibrating mortar plow comprising a bottom mortar engaging face carrying a plurality of spaced parallel fins, said method comprising: laying each brick on its front face on a flat surface to form a plurality of rows of bricks, leaving mortar spaces between adjacent rows of bricks and between the end faces of bricks in each row; orienting the bricks such that the end faces of the bricks in adjacent rows are staggered and at least one of said holes in each brick lines up with a hole in a brick of an adjacent row; applying wet mortar to the rear faces of the bricks; moving the vibrating mortar plow forwardly with the fins extending into the mortar spaces between adjacent rows of bricks, whereby the fins direct mortar downwardly into the spaces and into the holes to substantially completely fill the mortar spaces and the holes in the bricks; guiding the mortar plow along the rows of bricks by the fins being received in the mortar spaces between rows of bricks.

In another aspect, the present invention provides a brick wall panel comprising masonry bricks, wherein said bricks are oriented in a plurality of rows with mortar spaces being provided between adjacent rows and between the end faces of bricks in each row, the end faces of bricks in adjacent rows being staggered and at least one of said holes in each brick lining up with a hole in a brick in an adjacent row; the bricks joined by mortar which substantially completely fills the mortar spaces and the holes in the bricks; a plurality of cantilevering connecting ties, being capable of supporting the entire weight of the panel, are substantially uniformly spaced over the rear surface of the panel, each connecting tie having a first portion embedded in the mortar of the panel and a second portion projecting from the rear surface of the panel; the holes in the bricks align to form continuous columns passing through substantially all of the rows of bricks in the panel.

In yet another aspect, the present invention provides a building structure having a structural framework and composite wall panels secured to the framework, each composite wall panel comprising: a backing comprising a panel of precast concrete and a decorative facing spaced from the backing, said facing comprising a brick wall panel comprising masonry bricks; wherein coupling means secure the backing to the framework; and wherein the facing is connected to the backing in spaced relation from the backing substantially merely by a plurality of cantilevering connecting ties substantially uniformly spaced over the rear surface of the facing.

In yet another aspect, the present invention provides a building structure having a structural framework and composite wall panels secured to the framework, each composite wall panel comprising: a backing comprising a panel of precast concrete; a decorative facing spaced from the backing, said facing comprising at least one brick wall panel comprising masonry bricks, wherein: said bricks each have a top surface, a bottom surface, a front face, a rear face opposite the front face, and two end faces opposite one another, and each of said bricks has a plurality of holes extending through it from the top surface to the bottom surface; said bricks are oriented in a plurality of rows with mortar spaces being provided between adjacent rows and between the end faces of bricks in each row, the end faces of bricks in adjacent rows being staggered and at least one of said holes in each brick lining up with a hole in a brick in an adjacent row; the bricks are joined by mortar which substantially completely fills the mortar spaces and the holes in the bricks; the holes in the bricks align to form continuous columns passing through substantially all of the rows of bricks in each brick wall panel of the facing; the front faces of the bricks define a decorative front surface of the facing and the rear faces of the bricks define a rear surface of the facing; coupling means securing the backing to the framework; the facing being connected to the backing in spaced relation from the backing by a plurality of cantilevering connecting ties substantially uniformly spaced over the rear surface of the facing and extending across a space between the facing and the backing; each connecting tie having an end portion embedded in the mortar of the facing, at least one arm extending from the end portion and extending across the space between the facing and the backing, the arms having tips embedded in the backing.

BRIEF DESCRIPTION OF THE DRAWINGS

Further aspects and advantages of the present invention will become apparent from the following description, taken together with the accompanying drawings, in which:

FIGS. 11, 12 and 13 are isometric top, front and side views of a "W" connecting tie in accordance with the present invention;

FIGS. 14, 15 and 16 are isometric front, top and side views of a "U" connecting tie in accordance with the present invention;

DESCRIPTION OF THE PREFERRED EMBODIMENTS

Preferred embodiments of the present invention are now described with reference to FIGS. 1 to 7.

A preferred method for manufacturing an integral brick wall panel according to the present invention is now described.

Figure 1:
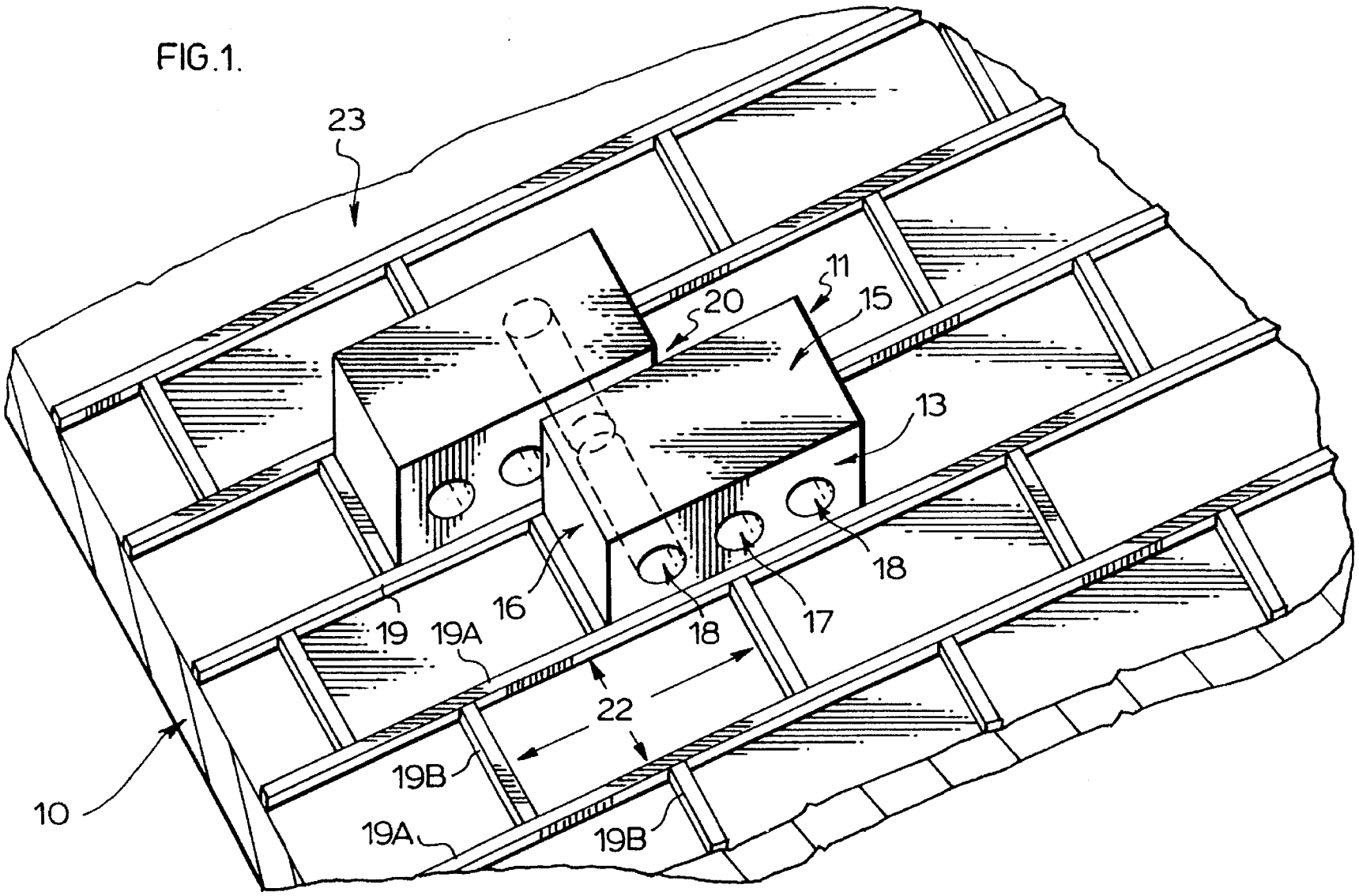
FIG. 1 is a top perspective view illustrating the orientation of the bricks on a frame base in a preferred method of manufacturing an integral brick wall panel according to the present invention.

FIG. 1 is a top perspective view of a portion of a frame base 10 having two conventional masonry bricks 11 arranged thereon. The frame base is preferably plywood or rubber. Each brick 11 has a top surface 12, a bottom surface 13, a front face 14, a rear face 15 and identical end faces 16. In FIG. 1, only the bottom surface 13, rear face 15 and one of the end faces 16 of each brick 11 are visible.

Each brick 11 preferably has a plurality of holes extending through the brick 11 from the bottom surface 13 to the top surface 12. Each brick 11 is shown as having a central hole 17 and two outer holes 18.

The base 10 on which the bricks 11 are arranged is preferably has sidewalls 23 to retain mortar, only one of which is shown. Preferably, the base 10 has spacing strips 19 which align the bricks 11 relative to one another so that mortar spaces 20 of conventional, uniform size are provided between adjacent bricks 11. The mortar spaces 20 preferably range in size from about ⅛ inch to about ⅞ inch. FIG. 1 illustrates a preferred form of spacing strips 19 comprising elongate strips of rubber having a rectangular cross-section which are adhered to the horizontal frame base 10.

The spacing strips 19 are attached in a pattern to base 10 to delineate rectangles 22 on the base 10, the rectangles 22 being sized to closely receive the front face 14 of a brick 11. The spacing strips 19 preferably extend upward into the mortar spaces 20 a distance of about ⅛ inch to about ¾ inch. Each rectangle 22 comprising spacing strips 19 preferably sealably engages each brick 11 on its top surface 12, bottom surface 13 and both end faces 16.

Although not shown in FIG. 1, bricks 11 are placed in all the rectangles 22 to completely cover the base 10. The rectangles 22 are constructed so that the bricks 11 will be arranged in staggered rows. The rows of bricks 11 comprise all the bricks 11 which are placed between two adjacent longitudinal spacing strips 19A. As shown in FIG. 1, the transverse spacing strips 19B of adjacent rows do not line up with one another, thus causing the end faces 16 of bricks 11 in adjacent rows to be staggered relative to one another.

The end faces 16 of the bricks 11 in adjacent rows are staggered to an extent that the two outer holes 18 of each brick will line up with outer holes 18 in bricks 11 of adjacent rows. In FIG. 1, the left hand outer hole 18 in lower brick 11 is shown lining up with the right hand outer hole (shown in dotted lines) of upper brick 11. In conventional masonry bricks having three holes such as that shown in FIG. 1, overlap of the outer holes 18 will occur when there is an overlap of 50 percent between bricks 11 of adjacent rows, meaning that the end faces 16 of every other row are aligned. Although not shown in FIG. 1, it is to be understood that the right hand end hole 18 of lower brick 11 will line up with the left hand outer hole 18 of a third brick 11, which will be positioned to the right of upper brick 11.

The base 10 is substantially completely covered with bricks 11, with the collective front faces 14 of the bricks forming the decorative front surface of an integral brick wall panel while the rear faces 15 of the bricks 11 collectively define the rear surface of the panel.

After all the bricks 11 are laid on their front faces 14 on the horizontal plywood frame base 10, wet cement mortar is applied to the rear faces 15 of the bricks 11 in an amount sufficient to fill all the mortar spaces 20 between bricks 11 as well as all the holes 17 and 18 in the bricks 11.

The mortar is worked into the mortar spaces 20 using a vibrating mortar plow, a preferred embodiment of which is now described with reference to FIGS. 2 and 3.

Figure 2:
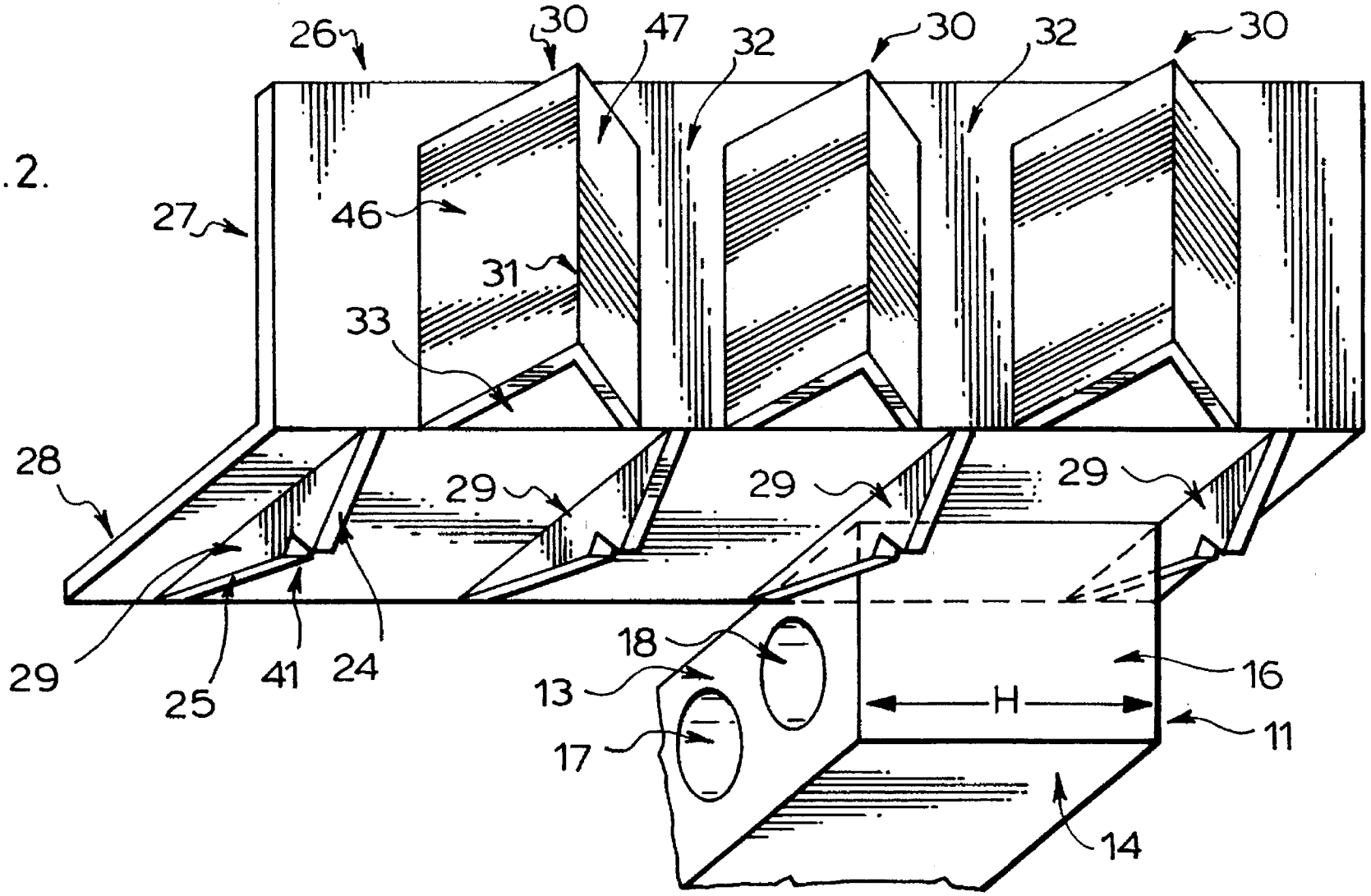
FIG. 2 is a bottom perspective view illustrating a vibrating mortar plow according to a preferred embodiment of the present invention in association with a complementary brick.

FIG. 2 illustrates a preferred vibrating mortar plow 26 according to the present invention. The plow 26 may preferably be formed principally from a length of angle iron. Plow 26 comprises a forward mortar engaging plowing face 27 and a bottom mortar engaging face 28, the bottom face 28 being joined to the forward face 27 and extending rearwardly therefrom.

Extending substantially perpendicular downwardly from the bottom face 28 and rearwardly along the bottom face 28 are a plurality of spaced, parallel fins 29. Adjacent fins 29 are spaced apart a uniform distance which is preferably slightly greater than the height H of a brick 11. The height H of a brick 11 is defined as the distance between the top surface 12 and bottom surface 13 of a brick 11.

The fins 29 preferably have a generally triangular shape and have a leading plow edge 24 which extends rearwardly and downwardly away from the bottom face 28, and a trailing edge 25 which extends forwardly and downwardly away from the bottom face 28. The trailing edge 25 is preferably provided with a notch 41.

The forward face 27 of plow 26 preferably comprises flow guides in the form of wedge members 30 which may comprise short lengths of angle iron. The wedge members 30 each have two leading edges 46 and 47 converging in a ridge 31, the wedge members 30 each being located between a pair of adjacent fins 29. Valleys 32 are preferably provided between adjacent wedge members 30, the valleys 32 being directly above the fins 29. The closed lower end 33 of each wedge member 30 forms a triangular projection on the bottom face 28, the lower end 33 of the wedge member 30 preferably being flush with the remainder of bottom face 28. This allows the plow 26 to slide smoothly on a bed of mortar.

Figure 3:
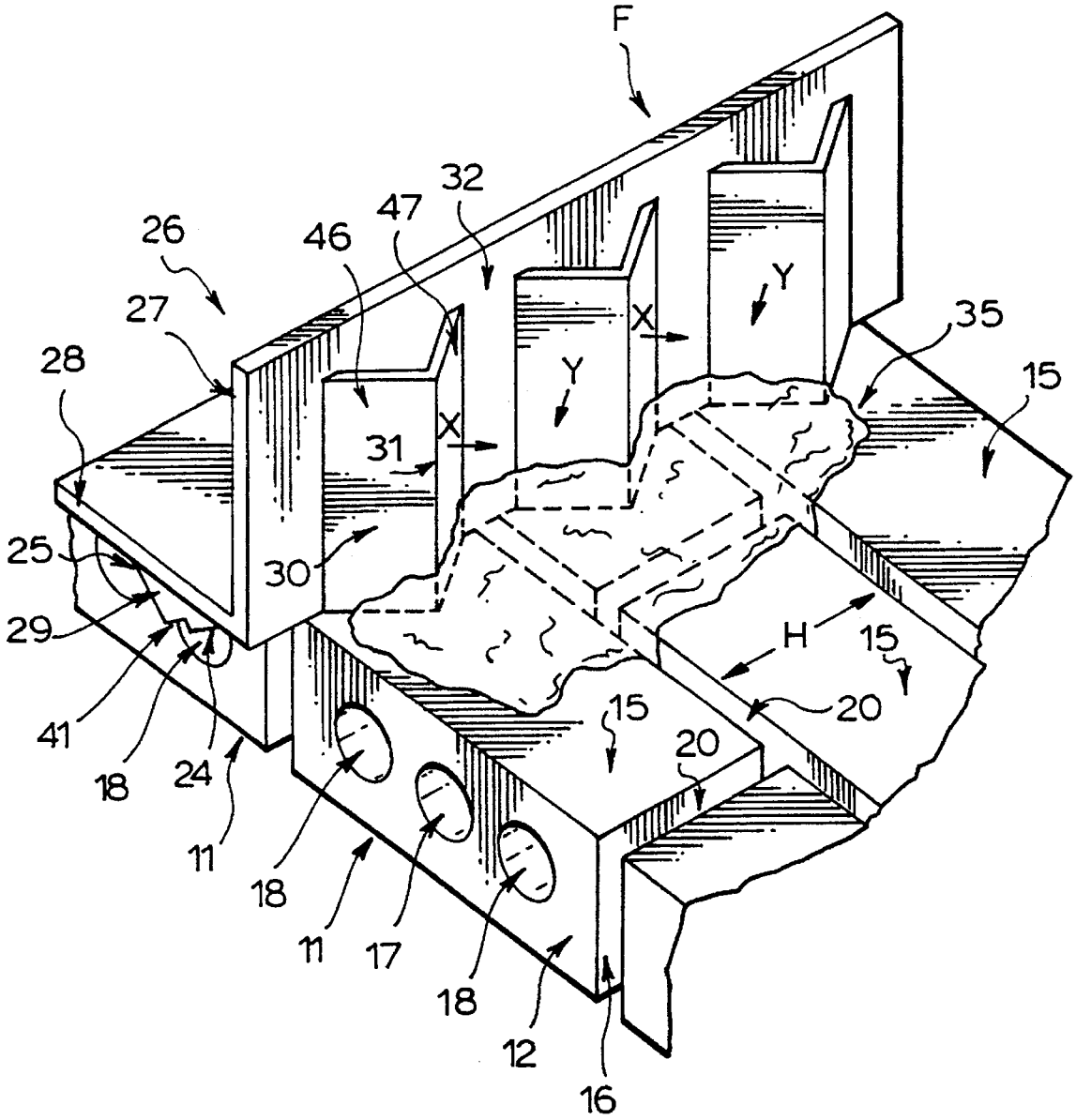
FIG. 3 is a top perspective view illustrating the mortar plow of FIG. 2 positioned on the rear surface of an integral brick wall panel according to a preferred method of the present invention.

To use the plow 26 of FIG. 2 in the preferred method of the present invention, it is first positioned as shown in FIG. 3 on the rear faces 15 of bricks 11, which have been arranged on the frame base 10 (not shown) as described above. Preferably, prior to positioning the plow 26, mortar 35 is applied to the rear faces 15 of bricks 11.

When properly positioned, the fins 29 (only one of which is shown in FIG. 3) of plow 26 are received in the mortar spaces 20 between adjacent rows of bricks 11. The wedge members 30 are each positioned above a brick 11 with the ridge 31 of each wedge member 30 being substantially centred on the rear face 15 of a brick 11. As shown in FIG. 3, the upper end 34 of wedge member 32 is open. While not necessary, the lower end of wedge 30 may be closed as by a metal plate 33 to assist the plow 26 in sliding on a layer of wet mortar 35.

The plow 26 may preferably be made by welding from a length of large metal angle iron substantially forming the faces 27 and 28 with shorter sections of smaller angle iron forming the wedge members 30 and with the fins 29 being cut from metal plate.

The use of plow 26 in a preferred method of the present invention is now described with reference to FIGS. 3 and 4.

After the plow 26 is positioned as shown in FIG. 3 and mortar 35 is applied to the rear faces 15 of bricks 11, the plow 26 is moved forwardly in the direction indicated by arrow F in FIG. 3.

When the plow 26 is pushed forward, the forward face 27 engages the wet mortar 35 and generally directs the mortar 35 in forward direction F. Simultaneously, the wedge members 30 direct the mortar 35 laterally away from the ridge 31 of each wedge member 30 to the mortar spaces 20 between adjacent rows of bricks 11. The leading edges 46 direct the mortar 35 in the direction indicated by arrows Y and leading edges 47 direct mortar 35 in the direction indicated by arrows X. Thus, the forward face 27 acts to push the mortar 35 forward and simultaneously direct it to the mortar spaces 20 between adjacent rows of bricks 11 by means of the wedge members 30.

Figure 4:
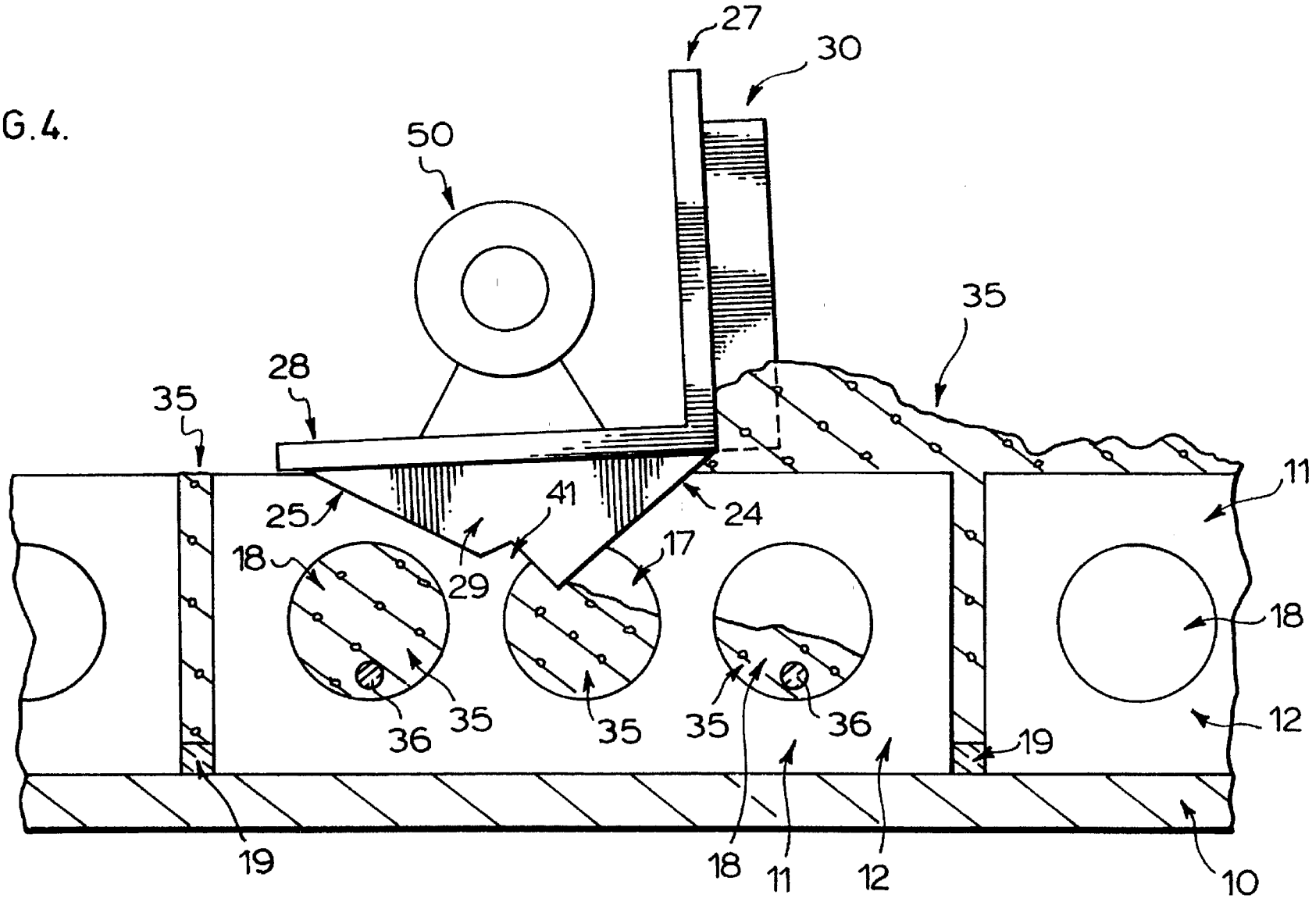
FIG. 4 is a cross-sectional side elevational view illustrating the vibrating mortar plow of FIG. 2 as used in a preferred method of the present invention.

As shown in FIG. 4, the plow 26 rides on a layer of wet mortar 35. When moved in forward direction F, the leading plow edge 24 of fin 29 contacts the mortar 35 which has entered mortar space 20 and forces it further downward into mortar space 20. The trailing edge 25 of fin 29 is shaped so that it will force mortar 35 down into mortar space 20 if the plow 26 may be moved rearwardly opposite to direction F. The trailing edge 25 is preferably provided with a notch 41 which increases agitation of the mortar 25 when the plow 26 is moved and thereby forces more mortar into the mortar space 20.

In FIG. 4, fin 29 is shown as extending downwardly into mortar space 20 to below the top of hole 17. The fin 29 preferably extends downward into the mortar space 20 to below the top of the three holes 17 and 18 in brick 11, to assist in ensuring the holes 17 and 18 become completely filled with mortar 35.

Each outer hole 18 is shown in FIG. 4 as having an internal reinforcing wire 36 inserted therein. These wires 36 are preferably inserted through the aligned holes 18 in the bricks 11 before mortar 35 is applied to the rear surfaces 15 of the bricks.

To avoid interference of the reinforcing wires 36 with the fins 29 when the plow 26 is moved along the bricks 11, the fins 29 preferably do not extend down to the lower portion of holes 18. Also, the reinforcing wires 36 are preferably of a small enough diameter that they do not interfere with movement of the fins 29. Preferably, the diameter of the wire 36 is about ⅛ to ⅜ inches.

The plow 26 is preferably repeatedly moved forwardly along the rows of bricks 11 until no more mortar 35 will flow into the mortar spaces 20 and the holes 17 and 18. At this point, the holes 17 and 18 in the bricks 11 are substantially completely filled with mortar 35. Thereafter, steps may be taken to ensure the mortar spaces 20 are filled to the rear faces 15 as by use of another plow similar to plow 26 but without fins 29 or by manual trowelling.

When in use, the plow 26 is preferably vibrated by by at least one eccentrically weighted hydraulic motor 50, which is schematically illustrated in cross-sectional side view FIG. 4. The at least one motor 50 preferably vibrates the plow 26 in three dimensions. The vibration of plow 26 assists in working mortar 35 down into mortar spaces 20.

The wet mortar 35 is preferably sufficiently fluid that it can flow into the mortar spaces 20 and into the holes 17 and 18 in the bricks 11. The mortar 35 may contain additives which cause it to set quickly but allow it to maintain its fluidity during the formation of the integral brick wall panel. Typically, the integral wall panel can be removed from the plywood frame base 10 and moved as a unit after a curing time of less than 24 hours.

Figure 5:
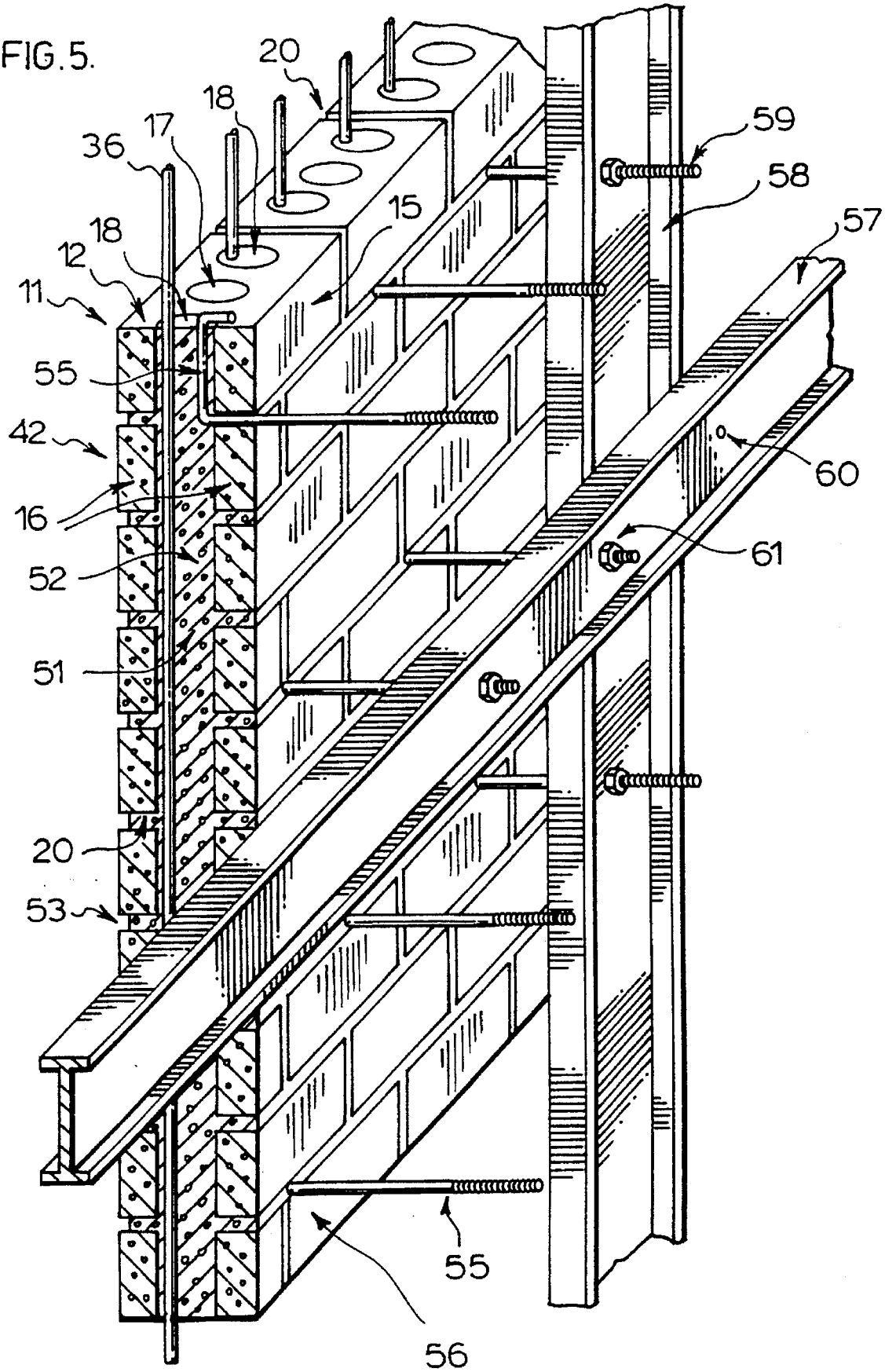
FIG. 5 is a partial cross-sectional side perspective view illustrating a preferred brick wall panel according to the present invention.

FIG. 5 illustrates a cross-sectional side view of a preferred integral brick wall panel 42 according to the present invention after being removed from base 10.

The bricks 11 of wall panel 42 are the same as those of FIG. 1, having one central hole 17 and two outer holes 18 extending through each brick 11 from the top surface 12 to the bottom surface 13. The end faces 16 of bricks 11 in adjacent horizontal rows are shown as being staggered by 50 percent, so that end faces 16 in every other row line up. The end holes 18 of the bricks 11 in adjacent rows are in alignment such that the holes 18 form continuous columns 51 extending through the entire height of the brick wall panel 42. The hardened mortar 52 extends between the bricks 11 and throughout the entire length of the columns 51 to form a network of columns of hardened mortar 52. Because the columns 51 and mortar spaces 20 are substantially completely filled by mortar 52, the resultant panel 42 has very surprising strength.

During formation of the panel 42, wet mortar 35 completely fills the spaces between bricks 20 and comes to engage the bricks 11 adjacent the spacing strips 19 on the horizontal base 10. This is illustrated in FIG. 4. The sealing engagement of the spacing strips 19 with the brick 11 prevents mortar 35 from flowing down into the mortar space 20 to the front faces 14 of the bricks. After the wet mortar 35 solidifies to form hardened mortar 52 and the panel 42 is removed from base 10, gaps 53 in the mortar 52 corresponding to the shape of the spacing strips 19 are left between adjacent bricks 11 on the front surface 54 (not shown) of the panel 42. The gaps 53 formed by spacing strips 19 eliminate the need to "point" the mortar joints between the bricks 11 which is very costly.

FIG. 5 shows a relatively thin internal reinforcing wire 36 extending through column 51 throughout the entire height of panel 42. The reinforcing wires 36 provide at least a small amount of additional strength to the panel 42 and can assist in preventing mechanical separation of portions of the panel 42 in the event the panel 42 becomes fractured. If desired, stronger reinforcing rods could be placed into the columns 51 to extend vertically through the panel 42.

Also shown in FIG. 5 are cantilevering connecting ties 55 projecting from the rear surface 56 of panel 42. The ties 55 are preferably L-shaped and are preferably inserted into a hole 17 or 18 in a brick 11 in the manner shown in FIG. 6. The connecting tie 55 is preferably inserted into a brick 11 before that brick 11 is laid on the plywood frame base 10. After the mortar spaces 20 and holes 17 and 18 are filled with mortar 35 and the mortar 35 hardens, the connecting ties 55 become firmly embedded in the hardened mortar 52.

The connecting ties 55 are preferably substantially uniformly spaced throughout the brick wall panel 42 so that the weight of the panel 42 may be completely supported by the cantilevering connecting ties 55 and the panel 42 does not need to otherwise be supported.

There is preferably one connecting tie 55 for every two to sixteen square feet of brick wall panel 42, and most preferably about one connecting tie 55 for every four square feet. The spacing of the connecting ties 55 is at least partially dependent on the strength and thickness of the ties 55. The ties 55 have a diameter less than the mortar spaces 20 between adjacent rows of bricks 11 so that they can easily fit through these spaces 20.

FIG. 5 schematically shows one method by which panel 42 may be attached by the connecting ties 55 to a building structure. Horizontal beam 57 and vertical beam 58 are schematically shown as building structural members to which cantilevering connecting ties 55 are attached. Connecting ties 55 are shown as being provided with threaded ends 59 which are inserted through holes 60 in beams 57 and 58 and secured with nuts 61. Although not shown in FIG. 5, all connecting ties 55 are to be similarly attached to building structural members so that the weight of the panel 42 may be supported only in a cantilevered manner by the ties 55.

Figure 7:
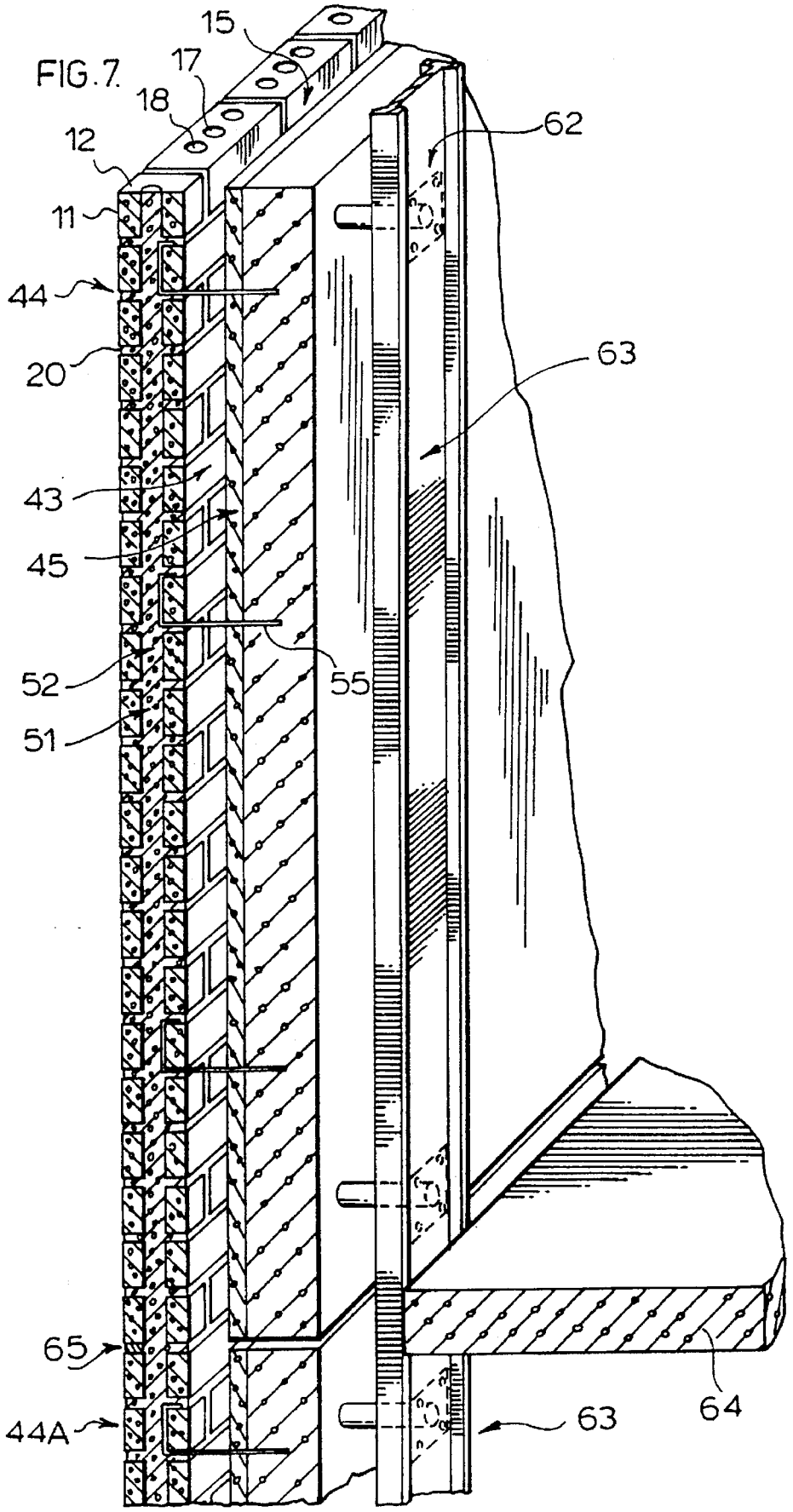
FIG. 7 is a partial cross-sectional perspective view illustrating a preferred manner in which an integral brick wall panel of the present invention is connected to a building structure.

A preferred use of the brick wall panel 42 is shown in FIG. 7, in which the brick wall panel 42 forms a facing layer for composite panel 44. The composite panel 44 comprises an interior structural backing of precast concrete 46 and the outer brick wall panel 42 forms the decorative facing. The inner concrete backing 46 and the outer brick wall panel 42 are separated by an interior air space 43.

To make this composite panel 44, a brick wall panel 42 such as that shown in FIG. 5, having connecting ties 55 projecting from its rear surface 56, is first prepared according to the preferred method of the present invention. The projecting ends of tie rods 50 are then embedded in concrete which is formed into the shape of backing 46. The resulting panel 44 has the brick panel 42 hung from the backing 46 by the cantilevering connecting ties 55, an air space 43 being provided between the backing 46 and the brick panel 42, with the ties 55 extending across the air space 43.

In a preferred form of the composite panel 44, a layer of rigid foam insulation 45 is provided between the backing 46 and the brick panel 42, with air space 43 being provided between the insulation 45 and the brick panel 42. In this embodiment, the projecting ends of the connecting ties 55 pass completely through the insulation 45 and are embedded in the backing 46, with the ties 55 extending across the air space 43 between the brick panel 42 and the insulation 45.

As shown in FIG. 7, the rear surface of the concrete backing 46 has connecting brackets 62 by which it is bolted or welded to building structural member 63 in a known manner. Below panel 44 is shown the top portion of an identical composite panel 44A which is attached to building structural member 63 in the same manner as panel 44. A building floor member 64 is shown coupled with member 63. The panels 44 and 44A do not engage floor member 64. A layer of caulking 65 is shown as closing the space between panels 44 and 44A so as to provide a weatherproof seal. Similar caulking joins the four sides of the panel 44 to adjacent panels.

Although the bricks 11 shown in the drawings have three holes 17 and 18 and the preferred staggering of the bricks is 50 percent, it is to be understood that the mortar plow and the method of the present invention can be used with a variety of different bricks and blocks with different hole configurations and different degrees of staggering.

Although the preferred brick wall panel 42 of FIG. 5 and the composite panel of FIG. 7 are shown as being bolted or welded to building structural members, it is to be understood that many suitable methods exist by which the panel 42 may be connected to a building structure.

Although FIG. 1 shows the spacing strips 19 as having a rectangular cross section, it is to be understood that the spacing strips 19 may have other shapes. For example, the spacing strips 19 may have a rounded top surface to provide a rounded gap 53 between bricks 11.

Although the brick wall panel 42 shown in FIG. 5 is rectangular, it is to be understood that many other shapes are possible. Further, the panel 42 may be provided with openings for windows.

Although the fins 29 have been shown in FIGS. 2 and 4 as being notched, it is to be understood that the notch 41 is not essential. Further, each fin 29 could be divided into two or more smaller fins, one behind the other.

Although the plow 26 has been described as being vibrated by a hydraulic motor, 50, it is to be understood that other types of known vibrating motors may be equally suitable for vibrating the plow 26.

Although the plow 26 has been described as having flow guides in the form of wedge members 30, it is to be understood that other configurations may also be suitable, as long the flow guides direct mortar 35 laterally to the fins 29.

Reference is now made to FIGS. 8 to 19 showing further aspects of the invention.

Figure 6:
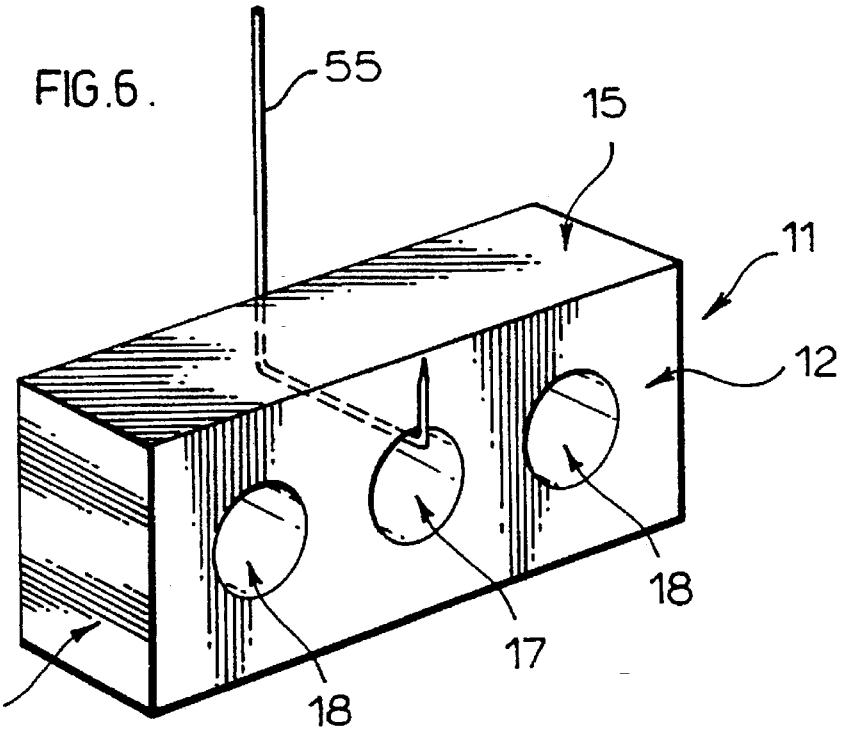
FIG. 6 is a perspective view illustrating a preferred brick and connecting tie combination according to the present invention.
Figure 8:
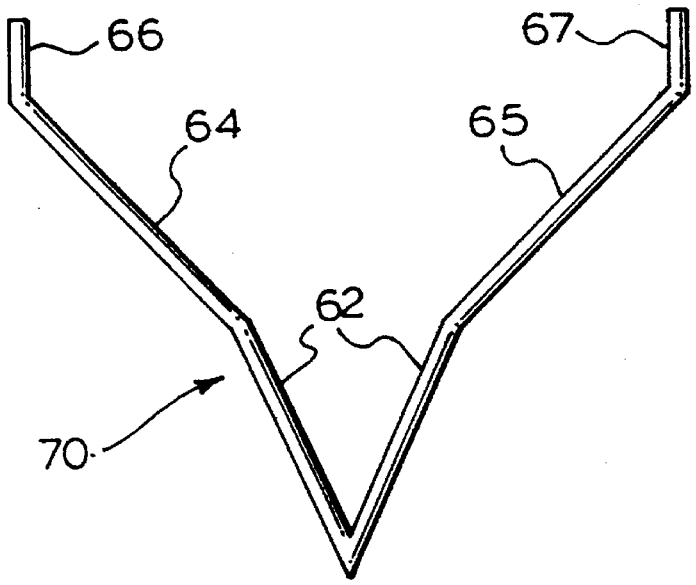
FIGS. 8, 9 and 10 are isometric top, front and side views of a "V" connecting tie in accordance with the present invention.
Figure 10:
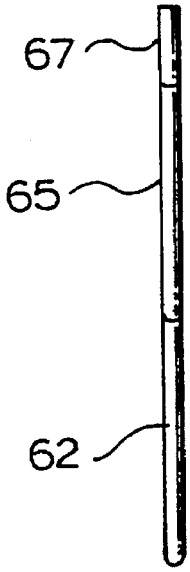
Figure 9:
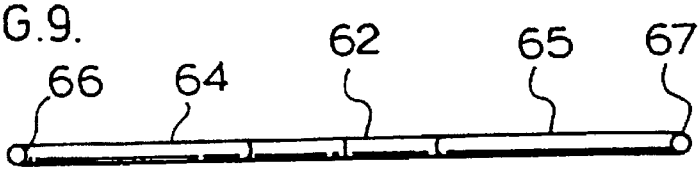

The cantilevered support of the wall panel 42 has been illustrated in FIGS. 5 and 6 utilizing L-shaped connecting ties 55. FIGS. 8 to 13 illustrate two other possible forms for connecting ties, with FIGS. 8 to 10 illustrating a tie referred to as the V-shaped tie 70 and FIGS. 11 to 13 illustrating a tie referred to as a W-shaped tie 80. Each has a planar central V-portion 62 lying in a plane and to be disposed in mortar between two rows of bricks. Each also has diagonal portions 64 and 65 extending from the central portion to two end portions 66 and 67 to be disposed in concrete backing 46. In both ties 70 and 80, the end portions 66 and 67 are in a plane parallel to the plane of the central V-portion 62. In the case of the V-shaped tie 70, portions 62, 64, 65, 66 and 67 all lie in the same plane. In the case of the W-shaped tie 80, end portions 66 and 67 are in a plane spaced from the plane in which the central V-portion 62 lies.

Figure 17:
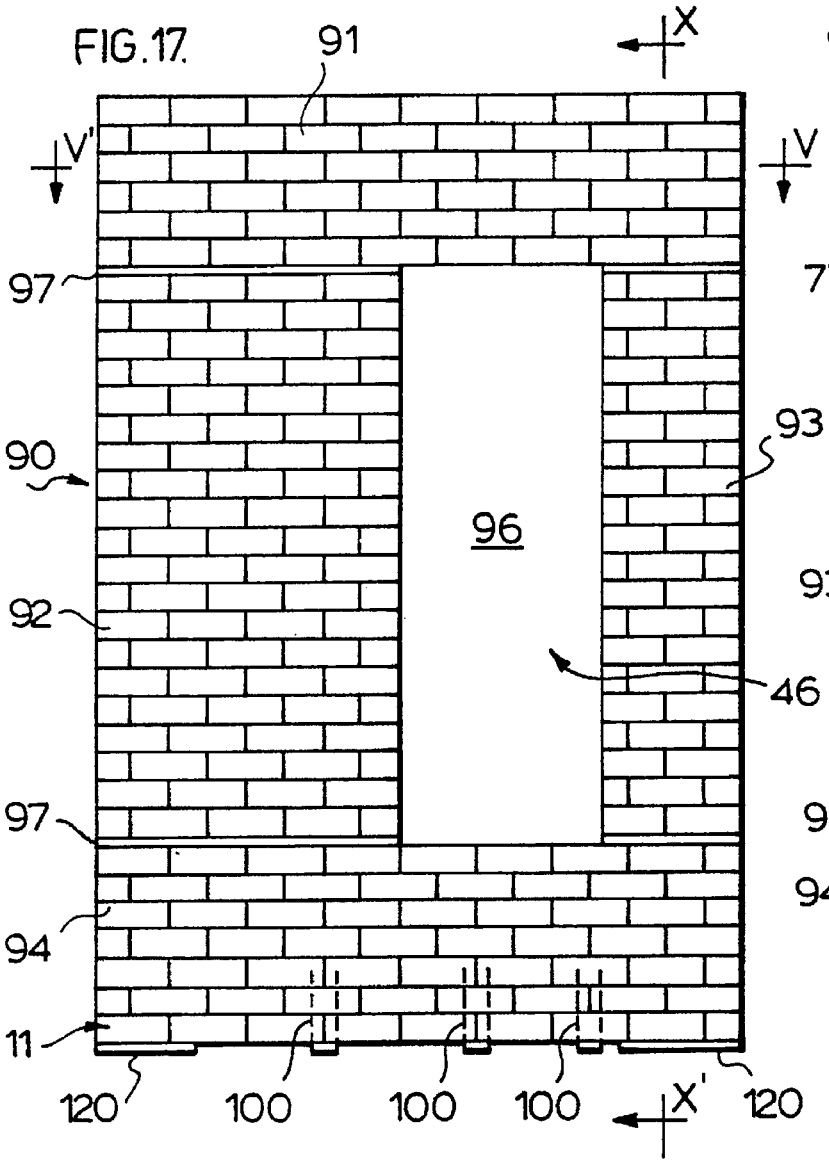
FIG. 17 is a front view of another composite brick panel in accordance with the present invention.

FIG. 17 is a front view of a composite panel 90 similar to that shown in FIG. 7 but having four separate brick panels 91, 92, 93 and 94 disposed about an opening 96 for a window. Each of the four panels 91 to 94 is independently coupled to concrete backing 46 by the use of connecting ties (not shown). Joints such as indicated as 97 between adjacent panels 92 and 94 are sealed with caulking. Providing four separate panels assists in permitting each panel to expand and contract due to different expansive forces which may act on each such that the cumulative expansive forces may be less likely to affect the structural integrity of each individual panel as contrasted with a structure in which all four panels 91, 92, 93 and 94 are a unitary brick panel.

Figure 18:
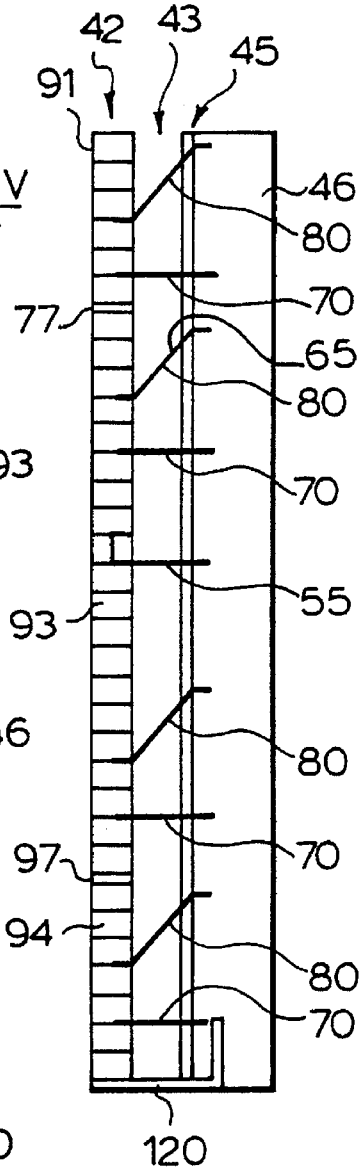
FIG. 18 is a cross-sectional side view through the composite panel of FIG. 17 along line X—X'.

FIG. 18 is a cross-sectional side view of panel 90 along line X—X' in FIG. 17. FIG. 18 shows W-shaped ties 80 in side view as having their diagonal portions 64 and 65 extending at an angle upwardly from the brick panel 42 to the concrete backing 46 to better bear vertical loading. The diagonal portions 64 and 65 may also extend downwardly at an angle. The diagonal portions 64 and 65 of W-shaped ties 80 form the diagonal portions of a vertical truss structure which supports the vertical load of panel 42. Preferably diagonal portions 64 and 65 extend across space 43 between brick panel 42 and concrete backing 46 at an acute angle of from about 30 to about 60 degrees from a vertical axis. V-shaped ties 70 and L-shaped ties 55 are also illustrated extending horizontally from brick panel 42 to the concrete backing 46. One or more of ties 70 and 55 combine with ties 80 to form the truss structure to rigidly support the brick panel 42 spaced from the concrete backing 46. The vertical tress preferably comprises a plurality of adjoining triangles. Each triangle has a first horizontal side comprising portion 64 or 65 of a V-shaped tie 70. Each triangle also has a second, diagonal side comprising a portion 64 or 65 of a W-shaped tie 80, and a third, vertical side comprising either the brick facing 42 or the concrete backing 46.

Figure 19:
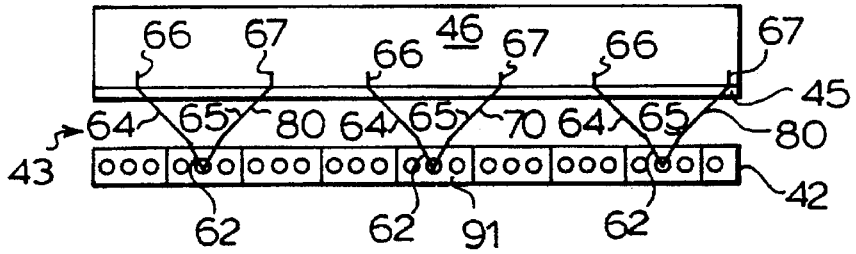
FIG. 19 is a cross-sectional elevational view through the composite panel of FIG. 7 along line V—V'.

FIG. 19 is a cross-sectional top view of panel 90 along line V—V' in FIG. 17. In top view, both W-shaped ties 80 and V-shaped ties 70 have their diagonal portions angling away from each other to thereby form a horizontal truss structure to bear lateral loading with or without the other ties. Insofar as the panel 90 may be shipped laid on its side rather than standing vertically, it is required that the truss structure be able to bear the full weight of the panel laterally.

FIGS. 14, 15 and 16 illustrate a U-shaped reinforcing tie 100 which is for use in securing the bottom row of bricks in any brick panel to a row or rows of bricks thereabove. U-shaped tie 100 has a central bight 101 and two generally parallel arms 102. The tie 100 is inserted so that its two arms 102 extend vertically upwardly with each arm in one of the holes 18 of each brick 11 in the bottom row of a brick panel with the bight 101 underneath the bottom bricks 11 extending along their bottom surfaces 13 between two holes 18. The bight 101 may either extend between two holes 18 of a single brick 11 or between holes 18 of adjacent bricks 11 in a row, thereby spanning mortar space 20 between the bricks 11.

The arms 102 are of sufficient length that they extend at least into the holes 18 in the row of bricks 11 above the bottom row and, more preferably, into at least the two rows of bricks 11 above the bottom row. The U-shaped ties 100 preferably have their arms 102 bent in a zigzagging fashion to increase the resistance to the ties 100 being withdrawn vertically downwardly out of the mortar filling the holes 18.

The ties 100 provide a mechanical safeguard against a brick 11 in a bottom row falling from the panel in the event of fracture of its mortar band. In FIG. 17, only three U-shaped ties 100 are shown in dotted lines for panel 94. Preferably, every brick 11 in a bottom row of every panel will be secured with a U-shaped tie 100.

FIGS. 17 and 18 also show concrete backing 46 as having a bottom support flange 120 which extends outwardly from the concrete backing 46 underneath the panel 94 and upon which at least some bricks 11 of the bottom row of the panel 94 sit. Support flange 120 is provided of a strength to bear substantially the totality of the vertical load of brick panel 42. While the bottom support flange 120 could be provided along the entire bottom edge of panel 94, preferably, as shown, it is provided only along a portion of the bottom edge and, particularly, only at outside edge portions. The support flange 120 is illustrated as an angle beam coupled to the concrete backing 46. Support flange 120 may be required in accordance with some building codes even though it is unnecessary where adequate ties 55, 70, 80 and 100 are provided.

Panels 91, 92 and 93 are shown as not supported by flanges similar to bottom support flanges 120, and a preferred construction is as shown in FIG. 17 with flanges 120 only supporting the bottom panel 94. Should failure of the ties for an upper panel, for example, panel 93, result in downward drooping of panel 93, then the panel 93 may engage the top of panel 94 and indirectly be supported by flanges 120.

Figure 20:
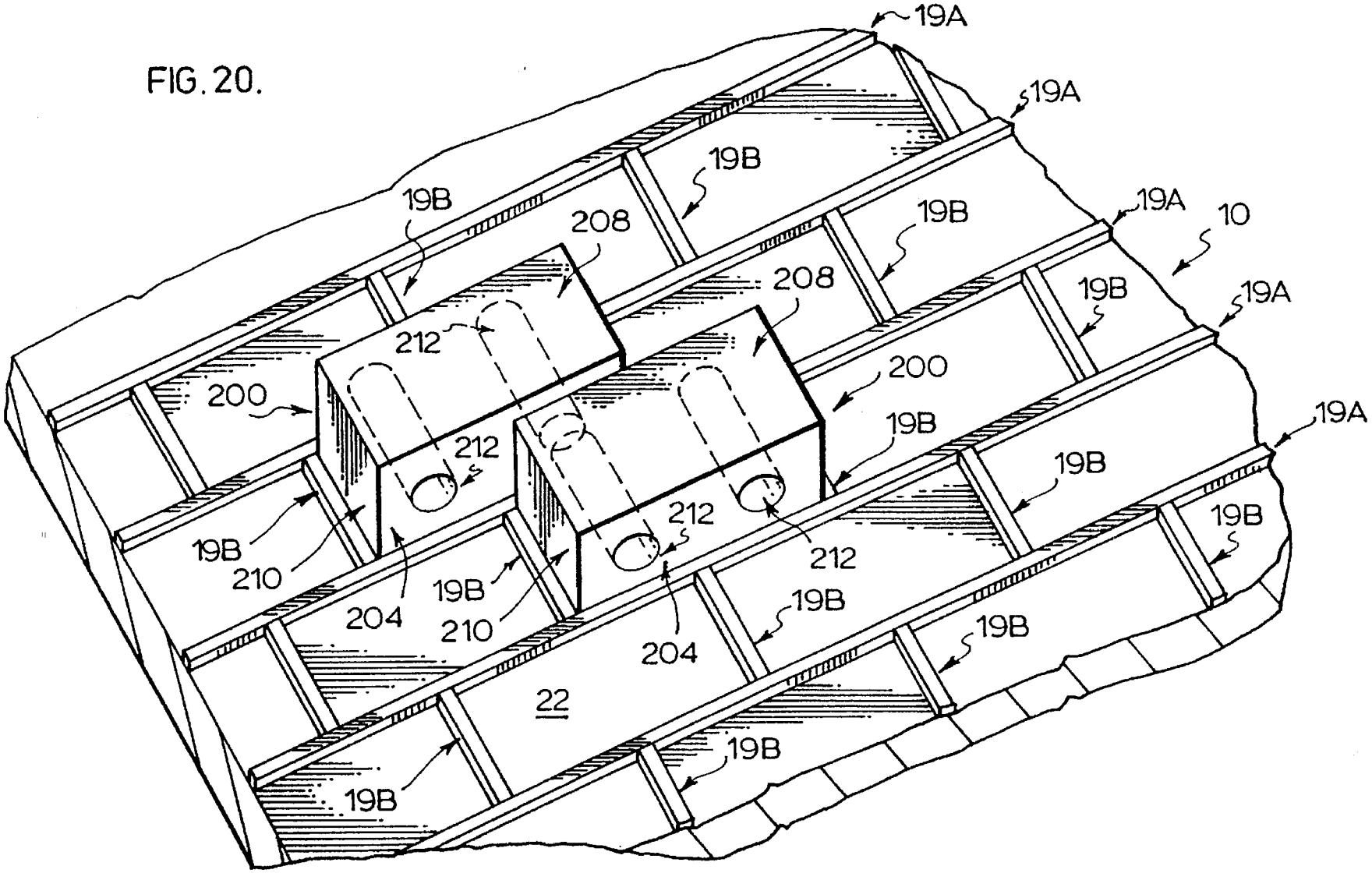
FIG. 20 is a top perspective view illustrating the orientation of bricks having two holes on a frame base in a preferred method of manufacturing an integral brick wall according to the present invention.

FIG. 20 is a top perspective view of a portion of a frame base 10 having two conventional masonry bricks 200 arranged thereon. Each brick 200 has a top surface 202 (not shown) and an opposite bottom surface 204, a front surface 206 (not shown) contacting base 10, an opposite rear surface 208 facing upwardly, and two identical end surfaces 210. The two bricks 200 shown in FIG. 20 are identical to bricks 11 shown in FIG. 1 with the exception that bricks 200 have two holes 212 extending therethrough from the bottom surface 204 to the top surface 202.

As in the case of bricks 11 shown in FIG. 1, when bricks 200 are arranged on base 10 staggered by 50 percent, the holes 212 of bricks 200 in adjacent rows line up to form continuous columns as discussed above with reference to bricks 11.

The method of the present invention may be used to produce brick wall panels according to the present invention comprising bricks 200 having two holes.

Although the invention has been described in connection with certain preferred embodiments, it is not intended that it be limited thereto. Rather, it is intended that the invention cover all alternate embodiments as may be within the scope of the following claims.

I claim:

1. A method for manufacturing integral wall panels from masonry bricks using a vibrating mortar plow, each of said bricks having a top surface, a bottom surface, a front face, a rear face opposite the front face, and two end faces opposite one another, each brick having a plurality of holes extending therethrough from the top surface to the bottom surface;

the mortar plow comprising a bottom mortar engaging face carrying a plurality of spaced parallel fins extending substantially perpendicularly downwardly from the bottom mortar engaging face;

said method comprising:

laying each brick on its front face on a flat surface to form a plurality of rows of bricks, leaving mortar spaces between adjacent rows of bricks and between the end faces of bricks in each row;

orienting the bricks such that the end faces of the bricks in adjacent rows are staggered and at least one of said holes in each brick lines up with a hole in a brick of an adjacent row;

applying wet mortar to the rear faces of the bricks;

moving the vibrating mortar plow forwardly with the fins extending into the mortar spaces between adjacent rows of bricks, whereby the fins direct mortar downwardly into the spaces and into the holes to substantially completely fill the mortar spaces and the holes in the bricks;

guiding the mortar plow along the rows of bricks with the fins being received in the mortar spaces between rows of bricks.

2. The method of claim 1, wherein the mortar plow additionally comprises a forward mortar engaging plowing face comprising flow guides, wherein when the plow is moved forwardly with the fins extending into the mortar spaces between rows of bricks, the forward face directs mortar forwardly, the flow guides direct mortar laterally to the mortar spaces between adjacent rows of bricks, and the fins direct mortar downwardly into the mortar spaces between adjacent rows of bricks and into the holes in the bricks.

3. The method of claim 2, wherein the flow guides include wedge members between adjacent fins, said flow guides having two leading edges, one leading edge directing mortar laterally into alignment with one adjacent fin and another leading edge directing mortar laterally into alignment with the other adjacent fin on movement of the plow forwardly.

4. The method of claim 1, wherein fins each have a the leading plow edge which extends at an angle rearwardly and downwardly away from the bottom face to direct mortar downwardly on movement of the plow forwardly.

5. A method for manufacturing integral wall panels from masonry bricks using a vibrating mortar plow, each of said bricks having a top surface, a bottom surface, a front face, a rear face opposite the front face, and two end faces opposite one another, each brick having a plurality of holes extending: therethrough from the top surface to the bottom surface;

the mortar plow comprising a bottom mortar engaging face carrying a plurality of spaced parallel fins extending substantially perpendicularly downwardly from the bottom mortar engaging face;

said method comprising:

laying each brick on its front face on a flat surface to form a plurality of rows of bricks, leaving mortar spaces between adjacent rows of bricks and between the end faces of bricks in each row;

orienting the bricks such that the end faces of the bricks in adjacent rows are staggered and at least one of said holes of each brick lines up with a hole in a brick of an adjacent row;

applying wet mortar to the rear faces of the bricks;

moving the vibrating mortar plow forwardly with the fins extending into the mortar spaces between adjacent rows of bricks, whereby the fins direct mortar downwardly into the spaces and into the holes to substantially completely fill the mortar spaces and the holes in the bricks;

guiding the mortar plow along the rows of the bricks with the fins being received in the mortar spaces between rows of bricks, wherein the fins of the plow extend downwardly from the bottom face a distance at least equal to a distance between the holes and the rear face of a brick.

* * * * *